United States Patent [19]

Farcasiu

[11] Patent Number: 4,460,458

[45] Date of Patent: Jul. 17, 1984

[54] PROCESS FOR DEMETALIZING PETROLEUM UTILIZING STRONG SOLID-PHASE BRONSTED ACIDS

[75] Inventor: Malvina Farcasiu, Princeton, N.J.

[73] Assignee: Mobil Oil Corporation, New York, N.Y.

[21] Appl. No.: 398,461

[22] Filed: Jul. 14, 1982

[51] Int. Cl.[3] ..... C10G 45/00; C10G 17/00; C10G 17/06; C10G 45/30

[52] U.S. Cl. ..... 208/252; 208/251 R

[58] Field of Search ..... 208/252, 251 R

[56] References Cited

U.S. PATENT DOCUMENTS

| | | | |
|---|---|---|---|
| 2,367,803 | 1/1945 | Schindler | 208/251 |
| 2,948,675 | 8/1960 | Case | 208/252 |
| 3,105,038 | 9/1963 | Ayers | 208/251 R |
| 3,165,462 | 1/1965 | Friedman et al. | 208/252 |
| 3,190,829 | 6/1965 | Erdman | 208/252 |
| 3,560,568 | 2/1971 | Resnick | 549/40 |
| 3,624,053 | 11/1971 | Gibbs et al. | 526/287 |
| 3,718,627 | 2/1973 | Grot | 526/240 |
| 3,919,077 | 11/1975 | Whitehurst | 208/252 |
| 4,025,459 | 5/1977 | Wristers | 208/143 |
| 4,036,737 | 7/1977 | Wristers et al. | 208/112 |
| 4,085,035 | 4/1978 | Wristers | 208/143 |
| 4,152,250 | 5/1979 | Inooka et al. | 208/254 X |
| 4,196,102 | 4/1980 | Inooka et al. | 252/450 |

FOREIGN PATENT DOCUMENTS

| | | | |
|---|---|---|---|
| 2344279 | 9/1972 | Fed. Rep. of Germany | 208/251 |

*Primary Examiner*—Delbert E. Gantz
*Assistant Examiner*—Helane E. Maull
*Attorney, Agent, or Firm*—Alexander J. McKillop; Michael G. Gilman; Van D. Harrison, Jr.

[57] ABSTRACT

Petroleum and petroleum fractions are demetalized by contacting them with a solid phase Bronsted acid, preferably a perfluorinated sulfonic acid resin or polymer. The petroleum or petroleum fraction can be dissolved in a solvent.

14 Claims, 1 Drawing Figure

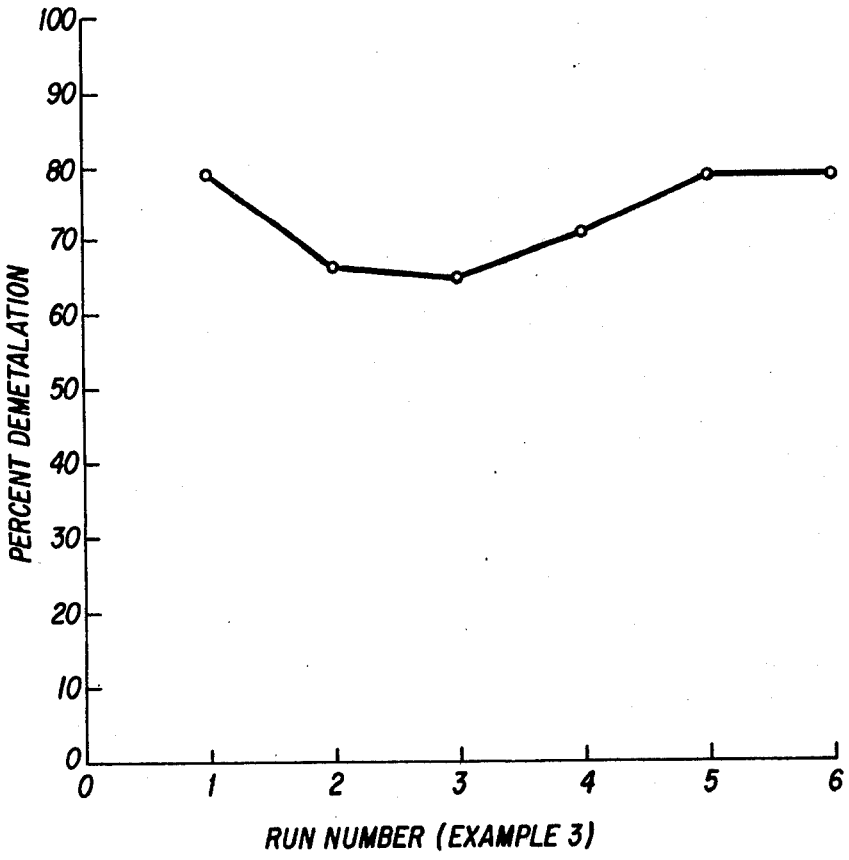
100
90
80
70
60
50
40
30
20
10
0
PERCENT DEMETALATION
0
1
2
3
4
5
6
RUN NUMBER (EXAMPLE 3)

PROCESS FOR DEMETALIZING PETROLEUM UTILIZING STRONG SOLID-PHASE BRONSTED ACIDS

BACKGROUND OF THE INVENTION

1. Nature of the Invention

This invention relates to processes for selectively demetalizing petroleum and petroleum fractions.

2. Description of the Prior Art

Organo-metallic compounds are contained in hydrocarbons, such as crude oils, heavy oils, cracked oils, deasphalted oil, topped residual oils, vacuum gas oils, tar sands, shale oils, or mixtures thereof. When these hydrocarbons are burned, these impurities are discharged along with sulfur and nitrogen into the atmosphere or waste water thus becoming a source of environmental pollution. The metals contained in the hydrocarbons are deposited on catalysts utilized in the catalytic treatment of hydrocarbons, causing marked decreases in the catalytic activity of the catalysts and their selectivity for a particular reaction. It is also becoming important to remove metals from hydrocarbons prior to removing other contaminants such as sulfur and nitrogen. The presence of the metals requires the excessive use of the catalyst which would be used to remove sulfur and nitrogen. It is thus important to develop a process for demetalizing these hydrocarbons in the presence of sulfur and nitrogen contaminants.

To remove heavy metal contaminants various approaches have been tried in the past. One very well known approach is hydrotreating. Other examples are U.S. Pat. Nos. 4,152,250 and 4,196,102 which disclose the use of a metal treated-sepiolite to effect selective demetalization of hydrocarbons. U.S. Pat. No. 3,190,829 discloses a method for removing heavy metal constituents by contacting the hydrocarbon oil containing the heavy metal in the liquid phase with a liquid alkyl sulfonic acid.

I have now determined that metals such as nickel and vanadium present as organo metallic compounds in the liquid hydrocarbons listed above can be removed by contacting the same with a strong solid-phase Bronsted acid.

DESCRIPTION OF THE DRAWING

The accompanying FIGURE is a plot of the data obtained from the test runs in Example 3.

DESCRIPTION OF THE INVENTION

Briefly stated this invention comprises a method for removing nickel, vanadium and other metals from petroleum or petroleum fractions by contacting these hydrocarbons with a strong solid-phase Bronsted acid at conditions effective to transfer the metal onto the resin. In another aspect, this invention comprises contacting these hydrocarbons with said solid while the hydrocarbon is mixed and diluted with an aromatic hydrocarbon or a petroleum fraction. The preferred diluents are those which have a boiling point not higher than about 428° F. (220° C.). A preferred solid-phase Bronsted acid is the hydrogen form of a fluorosulfonic acid resin (for example, a perfluorosulfonic acid resin which is a copolymer of tetrafluoroethylene and monomers such as perfluoro 3,6-dioxa-4-methyl-7-octenesulfonic acid). This is marketed by the E. I. Dupont de Nemours and Company, Wilmington, Del., under the tradename Nafion or Nafion-H. U.S. Pat. Nos. 3,718,627; 3,560,568; and 3,624,053 relate to the preparation of this materials. Other useful solid acids include fluorinated alkyl sulfonic acids supported on inorganic oxides.

In the method of this invention, the hydrocarbon oil or mixture of oil and aromatics is contacted with the solid-phase Bronsted acid in granular form. The ratio of solid to hydrocarbon oil can be between 0.5 and 5 parts by weight of solid to oil. A preferred ratio, however of solid to oil is between 1 to 2 parts of solid to 1 part of oil. Ordinarily the contacting can be conducted at atmospheric pressure and a temperature of 100° C. to 350° C. A preferred range of temperature, however is between 100° C. and 150° C. The upper limit of temperature, actually is limited only by the stability of the solid being used in the process. The period of contact can be between 0.5 to 24 hours although a period of between 0.5 and 5 hours is preferred. The mixing and contacting of hydrocarbon oil and solid can be effected in a batch process or in a continuous process. After a suitable contact time the granulated solid is separated from the oil or oil mixture by any desired means such as by filtering in a batch reactor or diversion of the oil stream in a continuous process. The treated oil mixture can then be further treated as desired such as by cracking, etc. A continuous process is desired over a batch process for commercial expediency. In a continuous process (preferably utilizing a fixed bed) the preferred liquid hourly space velocity will be between 0.3 and 2. If fixed beds are used, two or more beds can be operated in a parallel flow arrangement wherein one bed is on stream in the process while the other bed is undergoing regeneration. by contacting it with a mineral acid such as hydrochloric acid to extract the metal fraction. The metals contained on the solid will be dissolved and form metal salts. The metal components of these salts can subsequently be recovered.

As to determining which Bronsted acids are suitable for use in the process of this invention, this is best determined by simple test in which the petroleum or petroleum fraction to be demetallized is mixed either directly or in solution with a solid Bronsted acid which is a candidate for use in this invention. The mixture is allowed to react for a predetermined time. After the prescribed reaction time has elapsed, the solid-phase is removed and the liquid is analyzed for metal content. The degree of reduction in metal content indicates the suitability of the solid-phase Bronsted acid in question.

It is important to note that this process also effects some transalkylation of the oil being treated if it is mixed with the light aromatic solvent.

EXAMPLE 1

A 9.85-gram sample of Arabian Light Atmospheric Resid containing 17 ppm nickel and 70 ppm of vanadium was refluxed with 50 milliliters of dry xylene and 20 grams of acid resin (trade name Nafion H) for 24 hours. The xylene was then removed by distillation. The remaining product consisting of resid and transalkylated ortho-xylene in a concentration of 10% by weight of the initial resid was determined to contain 2.1 ppm of nickel representing a removal of 87.6% and 1 ppm of vanadium representing a 98.5% removal.

EXAMPLE 2

Portions of the resids listed in Table 1 where mixed with ortho-xylene in a ratio of 1 part of resid to 3 parts of ortho-xylene. The crude oils in the example were used without dilution. The solutions were then contacted with the same resin as that utilized in Example 1 in a ratio of 2 parts resin to 1 part of crude or resid. Contact temperature was 140° C. and contact time was as shown in Table 1. The solutions were filtered to remove the resin and analyzed for metal content. As much as 92% nickel was removed from one sample and as much as 98% vanadium was removed in another sample.

TABLE I

| | | % REMOVAL | |
|---|---|---|---|
| | TIME | NI | V |
| Arabian Light Vacuum Resid | 18 H | 87 | 98 |
| Cold Lake Atomspheric Resid | 8 H | 92 | 93.5 |
| Arabian Heavy Crude | 16 H | 84 | 94 |
| Boscan Crude | 6 H | 90 | 90 |

EXAMPLE 3

In another test an Arab Heavy Vacuum Resid was mixed with ortho-xylene in a ratio of 1 part of resid to 3 parts of xylene. The solution was then mixed with resin like that used in Example 1 in a ratio of 2 parts of resin to 1 part of resid and stirred in an autoclave at a temperature of 165° C. under an atmosphere of helium for 18 hours. At the end of each run the demetalized resid solution was removed and analyzed for metal content and a new resid solution was added. The same resin was retained, however in the autoclave and reused in each run. The results are presented in the accompanying figure.

What is claimed is:

1. A process for removing a heavy metal constituent from a hydrocarbon oil containing the same comprising contacting said hydrocarbon oil in the liquid phase with a fluorinated sulfonic acid polymer.

2. The process of claim 1 wherein said sulfonic acid polymer is a copolymer of tetrafluoroethylene and perfluoro 3,6-dioxa-4-methyl-7-octenesulfonic acid.

3. A process for removing a heavy metal constituent from a hydrocarbon oil containing the same comprising contacting said hydrocarbon oil in the liquid phase with a fluorinated sulfonic acid polymer, wherein the ratio by weight of sulfonic acid polymer to hydrocarbon oil is between about 0.5 and about 5 parts of polymer to 1 part of oil by weight.

4. The process of claim 3 wherein the ratio by weight of sulfonic acid polymer to hydrocarbon oil is between about 1 and about 2 parts by weight of polymer to 1 part of oil.

5. The process of claims 1, 2, 3 or 4 wherein contacting is conducted at a temperature between about 100° C. and about 250° C.

6. The process of claims 1, 2, 3 or 4 wherein contacting is conducted at a temperature between about 100° C. to 150° C.

7. The process of claims 1, 2, 3 or 4 wherein contacting is conducted at a temperature in excess of 100° C.

8. The process of claims 1, 2, 3 or 4 wherein said contacting is conducted for a period of between about 0.5 and about 24 hours.

9. The process of claims 1, 2, 3 or 4 wherein said contacting is conducted for a period of between about 0.4 and about 5 hours.

10. The process of claims 1, 2, 3 or 4 wherein said hydrocarbon oil is mixed with an aromatic hydrocarbon.

11. The process of claim 1 wherein the fluorinated sulfonic acid polymer is used in a plurality of fixed beds.

12. The process of claim 11 wherein at least one of said plurality of fixed beds is on stream while another is regenerated by acid.

13. The process of claim 11 wherein metals are recovered from the metal salts resulting from regeneration of the fixed catalyst bed.

14. The process of claim 11 wherein the process is conducted at an LHSV of 0.3 to 2.

* * * * *